US007467428B2

(12) United States Patent
Hanes

(10) Patent No.: US 7,467,428 B2
(45) Date of Patent: Dec. 23, 2008

(54) BED SHEET RETAINER SYSTEM

(76) Inventor: Floyd Raymond Hanes, 324 S. Urbana, Tulsa, OK (US) 74112

( * ) Notice: Subject to any disclaimer, the term of this patent is extended or adjusted under 35 U.S.C. 154(b) by 0 days.

(21) Appl. No.: 11/724,065

(22) Filed: Mar. 14, 2007

(65) Prior Publication Data

US 2008/0222807 A1 Sep. 18, 2008

(51) Int. Cl.
*A47G 9/04* (2006.01)

(52) U.S. Cl. ..... 5/498; 5/698; 24/72.5

(58) Field of Classification Search ..... 5/692, 5/486, 488, 498; 24/72.5
See application file for complete search history.

(56) References Cited

U.S. PATENT DOCUMENTS 2,507,091 A 5/1950 Carlson
4,712,262 A 12/1987 Viggiano
4,794,660 A 1/1989 Hawkrigg
4,967,430 A * 11/1990 Merkel ..... 5/669
5,033,139 A 7/1991 Renfro
5,044,028 A 9/1991 Sleeth

* cited by examiner

*Primary Examiner*—Michael Trettel
(74) *Attorney, Agent, or Firm*—Robert E. Massa

(57) ABSTRACT

A retaining device adaptable to place a bed cover easily and quickly in an accurate and secure position upon a bed comprises an elongated clamping component attachable at an end of a bed cover with cooperating symbols placed on the bed cover and clamping component to guide the positioning of the clamping component to guide the positioning of the clamping accurately to a chosen position. The clamping device comprises elongated members securely clamping an end portion of a bed cover for placement of the attached end of the bed cover beneath a mattress member according to said chosen location.

5 Claims, 2 Drawing Sheets

BED SHEET RETAINER SYSTEM

FIELD OF THE INVENTION

My invention relates to devices and systems for conveniently and quickly positioning and securing bed cover components in efficient position with a minimum of effort. More particularly, my invention provides the means for securing bed cover components in neat and secure position with a system of components which are easily adaptable for handling because of the provision of simple and light weight components.

BACKGROUND OF THE INVENTION

I had noticed for many years that the task of placing clean covers in position upon a bed is a time-consuming exercise which always seemed to require a great deal of expertise in accurately placing the covers in neat arrangement. A neat positioning of the bed covers always seemed to be made by initially positioning of the covers in a temporary position and then requiring many adjusting movements to attain the neatest possible position of the covers, hopefully a positive centering of the covers. This always took a great deal of time and effort.

I had also noticed attempts made by others to try to find ways of securing bed covers in place in order to resist the usual twisting and turning of the occupant.

I eventually conceived an idea to try to develop a system which provide means by which the person performing the bed-making tast would be able to place the covers in a neat position with a minimum of time and effort and also provide a means of assuring that the covers could be held in a secure position without being pulled away from the present condition of covering the sleeper.

Thus, in considering a possible manner in which I might be able to combine a result of being able to center a bed cover quickly and easily with a means of securing the bed covers in firm postion, I have been able to develop the invention which I describe herein.

I have designed my system to provide means for placing bed covers quickly and accurately in place and to provide a means for holding the covers securely in place.

To my knowledge, there has not been a bed cover retainer device which can easily and quickly provide both results.

In accordance with the usual practice, I had conducted a patent search, as a result of which I found the following patents which were considered to be the closest to my invention:

U.S. Pat. No. 2,507,091 to Carlson describes a holder component applicable to a blanket at the foot end of a bed to anchor that end of the blanket more securely in place. Carlson describes several different types of securing devices. FIG. 1 describes a holder comprising a bar 20 and a clamping plate 25. A portion of a blanket 17 is wrapped around the bar 20 and then Inserted within the slot formed by the clamping plate 25 and then positioned between the mattress and the box spring. FIGS. 5 and 6 describe a holder formed of two essentially identical corrugatable plates which hold a blanket portion therebetween by means of tubular member 35, and designed to be held in place by the corrugation of the members and the weight of the mattress and the person resting in place thereon. FIGS. 9 and 10 describe a holder essentially the same as in FIG. 5., but also being held in position by large springs 75.

U.S. Pat. No. 4,712,262, to Viggian, describes a bedding retainer comprising an "L"-shaped device which is intended to be initially put in position by placing the horizontal component between the waterbed mattress and the support platform of the bed. The sheet is spread over the mattress and vertical component of the holders and a rubber band is securing a portion of the bed sheet over the elongated lobe 18. FIGS. 3 and 4 describe alternate embodiments of the clamping members.

U.S. Pat. No. 4,794,660 to Hawkrigg describes a retaining device capable of holding a bed sheet in position by attachment of a retaining device at each cornier of a bed sheet with subsequent placing of the device at a corner of the bed beneath the mattress. The retaining device comprises a flat panel member foldable to engage a corner of the sheet which is inserted thru a flot in one portion of the device to be locked into position by the clamping result furnished when the holder is positioned beneath the mattress.

U.S. Pat. No. 5,033,139 to Renfro describes a securing apparatus of flat, elongated plastic material such as "VELCRO" or foam material which may be from 6 to 12 inches long or up to equal the width of the bed, to be placed between the bed sheet and box springs, thereby relying upon the high coefficient of static friction to act as the securing device.

U.S. Pat. No. 5,044,028 to Sleeth describes a sheet retaining device for a water bed comprising components which are engaed along each side of the bed frame. The bed frame includes a narrow space along each side. The retaining device comprises two components, an insert member and a retainer clip. The bed sheet is wrapped around the insert member and the insert member is placed within the retainer clip, then inserted into the space along the edge of the bed frame.

SUMMARY OF THE INVENTION

The primary object of my invention is to provide a bed sheet retainer system which is simple construction, efficient and easy to use, and safe to handle.

Another object of my invention is to provide a bed sheet retainer system which is accurate and convenient to operate, and is quick and easy to assemble.

Still another object of my invention is to provide a bed sheet retainer system which is adaptable to various sizes and types of beds and bed components.

I developed the prototype for my retaining device because I had an idea and I felt sure I could develop a simple method of assembling bed cover material and easily provide the components to reduce the effort of the bed-making task, and, at the same provide a means for maintaining the bed covers in neat and secure position. I felt that I have therefore invented a system that is efficient and easy to use for initially assembling the various bed covering material and which provides a simple device for holding the bed covers in secure position.

In the Figures I am showing a retainer component as securing a bed cover in a chosen position; where, in some cases, a retainer component may be at either head or foot of a bed, or if desired, a retainer component may be placed at both head and foot of a bed. Also, a retainer may be used to secure both a bed cover and a blanket together.

A retainer component comprises a major component of a retainer device, and the retainer component may be formed of smooth, rigid material, either wood, plastic, or metal.

Most importantly, my invention requires cooperation between, my retaining device and the chosen bed covers. I have accomplished this by providing certain locator means in cooperative position on the retaining device and the bed cover. The locator means may be provided accurately by means of accurately oriented symbols an both the retaining device and the bed cover.

I designed a suitable prototype for my invention to have dimensions for the thickness of material of about ⅛ inch, with a structural width of about 2 inches for a flat slab member of said retaining component and a width of about 2⅞ inches for an L-shaped clamping member of said invention. Both of said components should be made with all corners being smooth to prevent tearing or catching upon the retainer device by the bed cover material being used in cooperation with the retainer device.

In my description, I am, for clarity of explanation, describing my installation of a retaining device as it is to be placed in position on a bed in cooperation with a top bed sheet, as if that particular bed would already have thereon a fitted sheet in place on a mattress, and only a single top sheet is being described for the assembly operation. The installation of a retaining device could also be accomplished in similar fashion with cooperation of both a mattress covering sheet with a top sheet, and even in cooperation with a blanket. I believe that the advantage of my retaining device is clearly seen.

DESCRIPTION OF THE PREFERRED EMBODIMENTS

Figure 1:
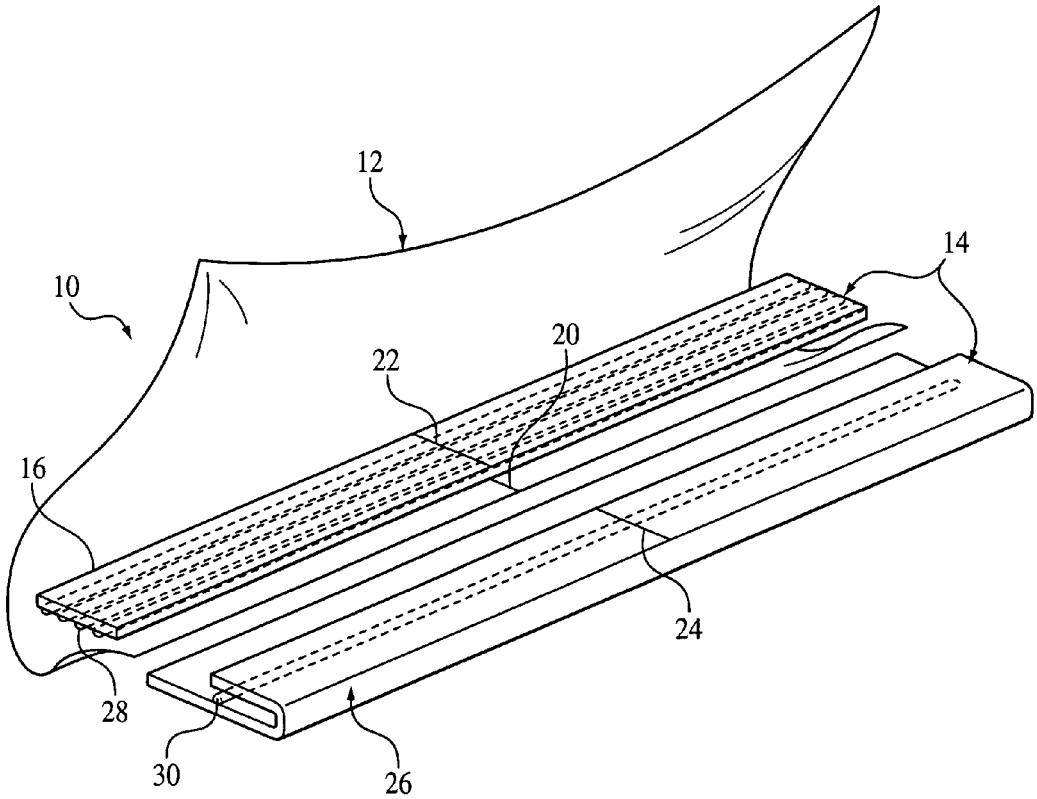
FIG. 1 is a partial side view of a retaining device assembled in preparation for ultimate assembly in cooperation with a typical bed.

In FIG. 1 I show a retaining device 10, generally, for accurately positioning and quickly and easily securing a bed cover, 12, generally, in position upon a bed, as I have begun to assemble the separate components in proper arrangement for placing in an operative position beneath a bed member 14, generally.

I prefer to describe a retaining device 10, generally, as including both the components of an apparatus which is attachable to a bed cover as well as a bed cover itself, since both a retaining apparatus and a bed cover are contributing to the total advantage of the invention.

Figure 2:
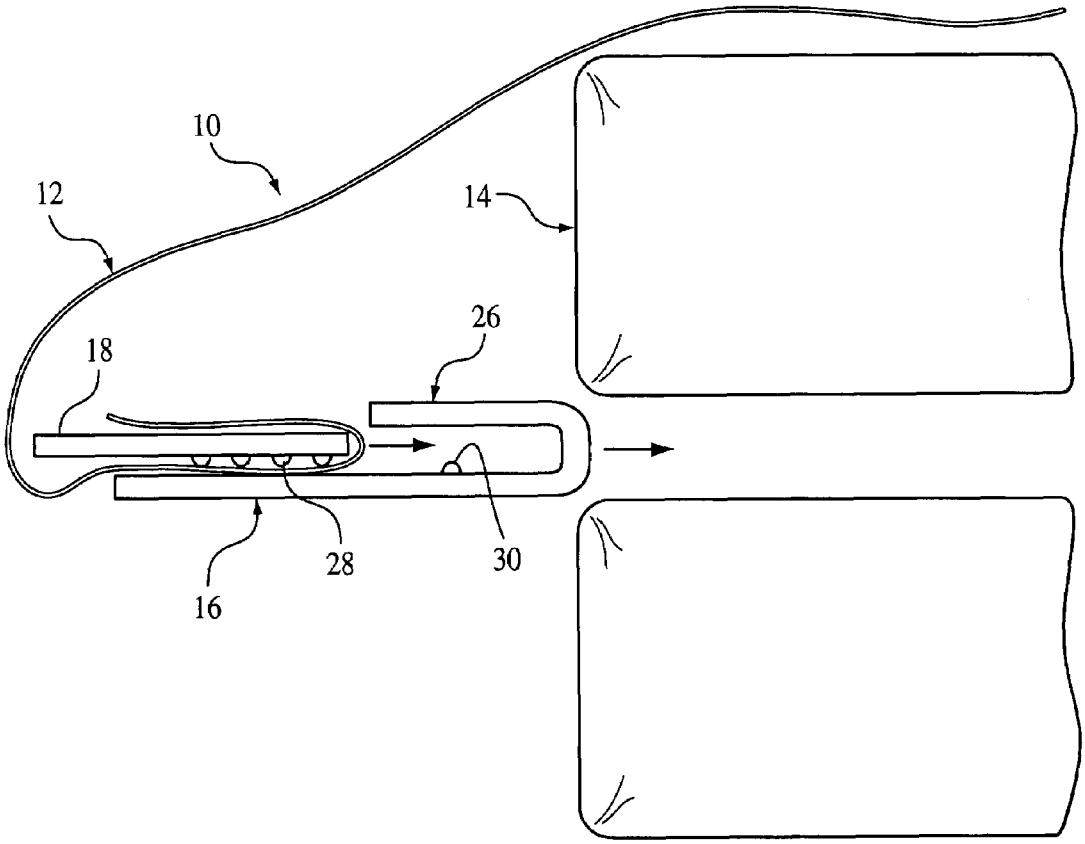
FIG. 2 is a side view of components for a retaining device shown in position for inclusion with the bed member.

I am preparing to coordinate the positioning of a bed cover 12, generally, in suitable position with a retainer component 16, generally, of my invention. I first line up a flat strip 18, generally, of retainer component 16, generally, in suitable agreement with bed cover 12, generally, by assuring adjacent positioning of a mid-point symbol 20 of bed cover 12, generally, with a mid-point symbol 22 on a flat strip 18. It then wrap about 1 inch of bed cover 12, generally, around flat strip 18. Then, I finish wrapping bed cover 12, generally, to a preferred condition in cooperation with retainer component 16, generally, as shown in FIG. 2.

I am then able to line up the enwrapped flat strip 18, generally, with mid-point 24 shown on L-shaped component 26, generally.

Figure 3:
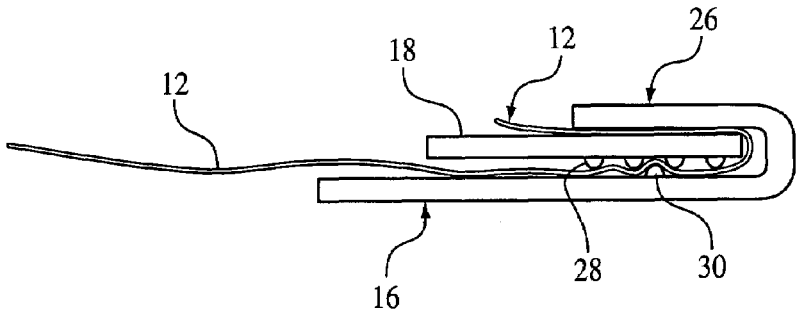
FIG. 3 is a side view of a retaining device in cooperation with a bed cover adaptable for assembly.

Then, with the bed cover accurately positioned in relation to the retainer component 16, generally, I am able to slide flat strip 18 into a secure position with L-shaped component 26, generally, by cooperation of securing component 28 on the surface of flat strip 18 with securing component 30 on the surface of L-shaped component 26, generally. I show the cooperation of this assembly in FIG. 3. The flat strip 18 snaps securely into place. Securing components 28 and 30 comprise ridged configurations on the retaining device 10, generally.

In my Figures I show the mid-point symbols, 22 on flat strip 18, and 24 on L-shaped component 26, in the form of lines etched or printed on the retaining components. These symbols may be, if chosen by the owner of the devices any form of suitable decorative, clearly visible mark. For convenience, symbols should be placed at each end of the bed sheets.

Figure 4:
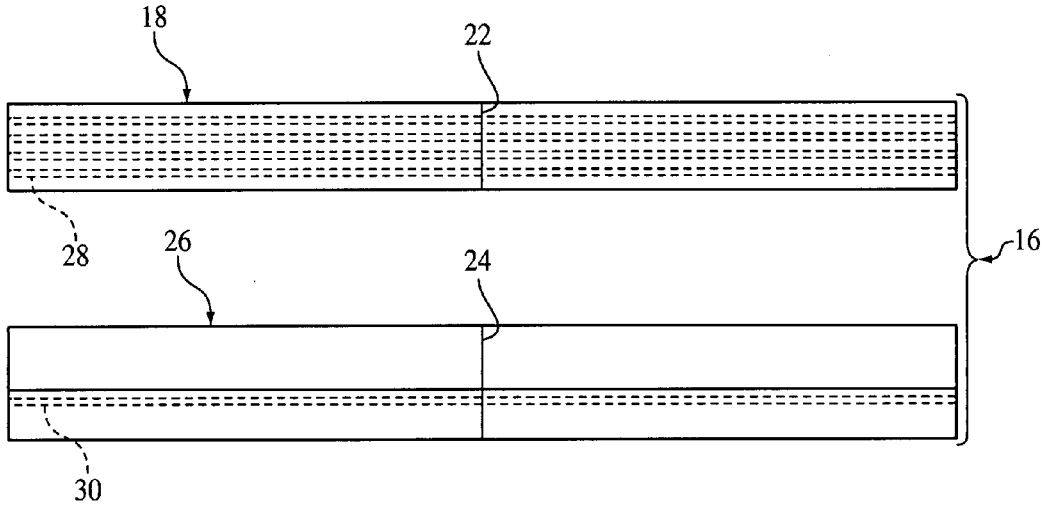
FIG. 4 is a perspective view of a retaining device and a bed cover in assembly in position for clusion with the bed member.

As I show in FIGS. 1 and 4, I prefer to have the securing ability for the retaining device established as a full length member on each retainer component, but it will operate sufficiently well if the retaining capability is expressed by having shorter strips being cooperatively placed on each retaining member.

Since many different embodiments of my invention may be made without departing from the spirit and scope thereof, it is to be understood that the specific embodiments described in detail herein are not to be taken in a limiting sense, since the scope of the invention is best defined by the appended claims.

I claim:

1. A retaining device for quickly positioning and securing a bed cover in accurate position upon a bed, comprising:

a retainer component comprising:

an elongated clamping member having accurately positioned locator means thereon, an elongated slab having accurately positioned locator means thereon, and said elongated slab wrapped by portion of bed cover and positionable within said clamping member in cooperative position with said locator means, wherein said retainer component is positioned accurately and securely beneath a bed component.

2. A retaining device for quickly positioning and securing a bed cover in accurate position upon a bed as described in claim 1, wherein:

an accurate position of retainer component is provided by making locator means comprise a mid-point symbol on adjacent components.

3. A retaining device for quickly positioning and securing a bed cover in accurate position upon a bed as described in claim 2, wherein:

said retainer component comprises a clamping member and a slab member of substantially equal length.

4. A retaining device for quickly positioning and securing a bed cover in accurate position upon a bed as described in claim 3, wherein:

said locator means comprises an add-on component.

5. A retaining device for quickly positioning and securing a bed cover in accurate position upon a bed as described in claim 4, wherein:

said retainer component prises adjacent members each having securing components on opposite surfaces in cooperable position.

* * * * *